US006814049B2

(12) United States Patent
Vogel et al.

(10) Patent No.: US 6,814,049 B2
(45) Date of Patent: Nov. 9, 2004

(54) METHOD OF OPERATING A DIRECT FUEL INJECTED INTERNAL COMBUSTION ENGINE

(75) Inventors: Manfred Vogel, Ditzingen (DE); Werner Herden, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 96 days.

(21) Appl. No.: 10/296,928

(22) PCT Filed: Feb. 13, 2002

(86) PCT No.: PCT/DE02/00498

§ 371 (c)(1),
(2), (4) Date: Nov. 29, 2002

(87) PCT Pub. No.: WO02/079642

PCT Pub. Date: Oct. 10, 2002

(65) Prior Publication Data

US 2004/0025833 A1 Feb. 12, 2004

(30) Foreign Application Priority Data

Mar. 29, 2001 (DE) ..... 101 15 597

(51) Int. Cl.[7] ..... F00B 5/00
(52) U.S. Cl. ..... 123/305; 123/339.1
(58) Field of Search ..... 123/305, 339.1, 123/339.11, 406.11, 295

(56) References Cited

U.S. PATENT DOCUMENTS 4,349,008 A 9/1982 Wainwright
RE33,270 E * 7/1990 Beck et al. ..... 123/447
5,170,760 A 12/1992 Yamada et al.
5,724,927 A * 3/1998 Suzuki ..... 123/90.15
5,913,302 A 6/1999 Ruman et al.
5,915,349 A 6/1999 Biemelt et al.
6,067,957 A * 5/2000 Motose et al. ..... 123/305
6,085,733 A 7/2000 Motoyama et al.
6,131,555 A 10/2000 Tozzi et al.
6,176,215 B1 1/2001 Baur et al.

OTHER PUBLICATIONS

"Kraftfahrtechnisches Taschenbuch/Bosch", 22nd edition, Springer–Verlag, 1998, pp. 369 and 442.

* cited by examiner

*Primary Examiner*—John T. Kwon
(74) *Attorney, Agent, or Firm*—Walter Ottesen

(57) ABSTRACT

The invention relates to a method for operating a direct-injecting gasoline internal combustion engine (1), especially of a motor vehicle, wherein the gasoline is injected directly into the combustion chamber (4) of the engine (1) and an ignition spark is ignited in the combustion chamber (4). In order to be able to reliably ignite an air/gasoline mixture with a relatively low ignition voltage notwithstanding a relatively large electrode gap of a spark plug (10) of the engine (1), it is suggested that the ignition spark be ignited in advance of the start of injection (45) and that a spark burn duration (44) be maintained up to past the end of the injection (45).

9 Claims, 2 Drawing Sheets

METHOD OF OPERATING A DIRECT FUEL INJECTED INTERNAL COMBUSTION ENGINE

FIELD OF THE INVENTION

The present invention relates to a method for operating a direct-injecting gasoline internal combustion engine, especially of a motor vehicle. In the method, gasoline is directly injected into a combustion chamber of the engine and an ignition spark is ignited in the combustion chamber.

The invention furthermore relates to a storage element for a control apparatus of a direct-injecting gasoline internal combustion engine especially of a motor vehicle. A computer program is stored on the storage element and can be run on a computing apparatus, especially on a microprocessor. The storage element is, for example, configured as a read-only-memory, a random-access-memory or as a flash memory.

The present invention also relates to a computer program which can be run on a computing apparatus, especially on a microprocessor.

Finally, the invention relates to a control apparatus for a direct-injecting gasoline internal combustion engine, especially of a motor vehicle. The control apparatus serves for controlling the injection of gasoline into a combustion chamber of the internal combustion engine and the ignition of an ignition spark in the combustion chamber.

BACKGROUND OF THE INVENTION

In direct-injecting gasoline internal combustion engines known from the state of the art, gasoline is injected directly into the combustion chamber of a cylinder of the internal combustion engine. The air/gasoline mixture, which is compressed in the combustion chamber, is then ignited by igniting an ignition spark in the combustion chamber. The volume of the ignited air/gasoline mixture expands explosion-like and imparts movement to a piston which is reciprocally movable in the cylinder. The reciprocal movement of the piston is transmitted to a crankshaft of the engine.

Direct-injecting internal combustion engines can be driven in various operating modes. As a first operating mode, a so-called stratified operation is known which is used especially for smaller loads. As a second operating mode, a so-called homogeneous operation is known which is utilized with larger loads applied to the engine. The various modes of operation are distinguished especially as to the injection time point and the injection duration as well as with respect to the ignition time point.

In stratified operation, the gasoline is injected into the combustion chamber during the compression phase of the engine in such a manner that a fuel cloud is disposed in the direct vicinity of a spark plug at the time point of ignition. This injection can take place in various ways. Accordingly, it is possible that the injected fuel cloud is already at the spark plug during or directly after the injection and is ignited by the spark plug. Likewise, it is possible that the injected fuel cloud is guided by a charge displacement to the spark plug and is only then ignited. In both combustion methods, no uniform fuel distribution is present in the combustion chamber, rather, a stratified charge is present.

The advantage of the stratified operation is that the applied smaller loads can be carried out by the engine with a very low fuel quantity. Larger loads can, however, not be satisfied by the stratified operation.

In the homogeneous operation, which is provided for such large loads, the gasoline is injected during the induction phase of the engine so that a swirling and therefore a distribution of the gasoline in the combustion chamber takes place easily already in advance of the ignition. Thus, the homogeneous operation corresponds approximately to the type of operation of internal combustion engines wherein fuel is injected into the intake manifold in a conventional manner. As required, the homogeneous operation can be used also for smaller loads.

In the stratified operation, a throttle flap is opened wide in an intake manifold leading to the combustion chamber and the combustion is controlled essentially (open loop and/or closed loop) only by the fuel to be injected. In homogeneous operation, the throttle flap is opened or closed in dependence upon the requested torque and the fuel mass, which is injected, is controlled (open loop and/or closed loop) in dependence upon the inducted air mass.

In both operating modes, that is in stratified operation and in homogeneous operation, the fuel mass, which is to be injected, is additionally controlled (open loop and/or closed loop) in dependence upon a plurality of additional operating variables to an optimal value with respect to a saving of fuel, exhaust-gas reduction, noise reduction and the like. The control (open loop and/or closed loop) is different in the two modes of operation.

In jet-guided BDE combustion methods in stratified operation, it is purposeful to ignite directly in front of an injection nozzle, that is, at the jet root. This can be reliably achieved in that the spark gap of a spark plug is arranged in the region of the jet root and the ignition spark burns at a time point at which the geometric jet end of the injected gasoline jet passes the spark gap. In the jet-guided BDE combustion method, injection is very late and the piston is already disposed close to top dead center. For this reason, the density of the air/fuel mixture, which is disposed in the combustion chamber, is very high. This has a high ignition voltage requirement and is typically approximately 25 kV at an electrode spacing of 1 mm. Electrode distances of significantly more than 1 mm cannot be realized with an ignition voltage of approximately 30 kV which is available at the present time.

The foregoing notwithstanding, it is especially the desire for the jet-guided BDE combustion method to be able to realize electrode distances of significantly more than 1 mm, for example, 5 mm or more in order, for example, to be able to ignite a plurality of individual jets of a multi-hole nozzle in common or to be able to ignite transversely through the jet root of the injection jet. Large electrode gaps of this kind would require, however, ignition voltages of significantly more than 50 kV to ignite the air/gasoline mixture. These ignition voltages are not realizable because of the size, the needed insulation complexity and the high costs.

SUMMARY OF THE INVENTION

The present invention is therefore based on the task of making possible the safe and reliable ignition of an air/gasoline mixture in a combustion chamber of a direct-injecting internal combustion engine at a relatively low ignition voltage with a spark plug having a clearly increased electrode gap.

To solve this task, the invention proceeds from the method of operating a direct-injecting gasoline internal combustion engine of the type mentioned initially herein by suggesting that the ignition spark is ignited in advance of the injection and a spark duration beyond the end of the injection is maintained.

According to the invention, the ignition spark is ignited at such an early time point that the ignition voltage, which is applied to the spark plug, is sufficient notwithstanding a large electrode gap because of the then relatively low density in the combustion chamber. At the time point of the ignition of the ignition spark, the piston is disposed still relatively far from top dead center and the volume, which is contained in the combustion chamber, is not yet especially intensely compressed. The ignition spark will then burn up to beyond the end of the subsequent following injection. The combustion voltage of a spark plug is considerably less than the ignition voltage. For this reason, the conventional voltage of approximately 30 kV, which is applied to the spark plug, is sufficient notwithstanding the clearly increased electrode gap in order to reinforce the spark and to thereafter permit combustion with increasing density.

According to the invention, it has been recognized that especially for a jet-guided combustion method in stratified operation, the actual time interval, which is required for a successful ignition of the air/fuel mixture, is coupled closely to the end of the injection because the mixture can only successfully thoroughly combust when the jet end is ignited. This means that it is only important to cover this actual time interval of the combustion duration of the ignition spark. It is, however, of no significance when the ignition spark is ignited clearly earlier or burns clearly later. The thermodynamically relevant time-dependent position of the centroid of the combustion therefore is especially dependent upon the start and the duration of the injection.

The temperature, which is required for the combustion of the air/fuel mixture, is not brought forth within the shortest time by an ignition spark which is applied for a short time. Rather, the required ignition energy accumulates over a longer time span, namely, from the ignition of the ignition spark in advance of the start of the injection up to reaching the actual time interval subsequent to the end of the injection.

According to an advantageous further embodiment of the invention, it is suggested that the internal combustion engine is driven in a stratified operation. Furthermore, it is suggested that the internal combustion engine is operated jet-guided. Additional information as to the jet-guided BDE combustion method can be obtained from the text "Kraftfahrtechnisches Taschenbuch/Bosch", 22nd edition, Springer-Verlag, 1998, page 369. Reference is expressly made to this publication.

According to another advantageous embodiment of the present invention, it is suggested that the spark duration is maintained until the geometric end of an injection jet has passed the ignition location. According to this embodiment, the fact is taken into account that the air/fuel mixture can only successfully thoroughly combust when the jet end is ignited. By means of an ion flow probe projecting into the combustion chamber, it can, for example, be determined when the jet end has passed the ignition location. Further information as to the ion flow measuring method is provided in the "Kraftfahrtechnisches Taschenbuch/Bosch", page 442. Reference is expressly made to this publication.

Of special significance is the realization of the method of the invention in the form of a storage element which is provided for a control apparatus of a direct-injecting gasoline internal combustion engine, especially of a motor vehicle. A computer program is stored on the storage element which can be run on a computing apparatus and especially on a microprocessor and is suitable for carrying out the method of the invention. In this case, the invention is therefore realized by a computer program stored on the storage element so that this storage element, provided with the computer program, defines the invention in the same way as the method for whose execution the computer program is suitable. As a storage element, an electric storage medium can be used, for example, a read-only-memory, a random-access-memory or a flash memory.

The invention also relates to a computer program of the kind mentioned initially herein which is suitable for carrying out the method of the invention when it runs on the computing apparatus. It is especially preferred when the computer program is stored on a storage element especially on a flash memory.

As an additional solution of the task of the present invention, and proceeding from the control apparatus for a direct-injecting gasoline internal combustion engine of the type mentioned initially herein, it is suggested that the control apparatus triggers an ignition of the ignition spark in advance of the injection and initiates a spark duration up to beyond the end of the injection.

Finally, as a further solution of the task of the present invention and proceeding from the direct-injecting gasoline internal combustion engine of the type mentioned initially herein, it is suggested that the ignition equipment ignites the ignition spark in advance of the start of the injection and supplies a spark duration up to beyond the end of the injection.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
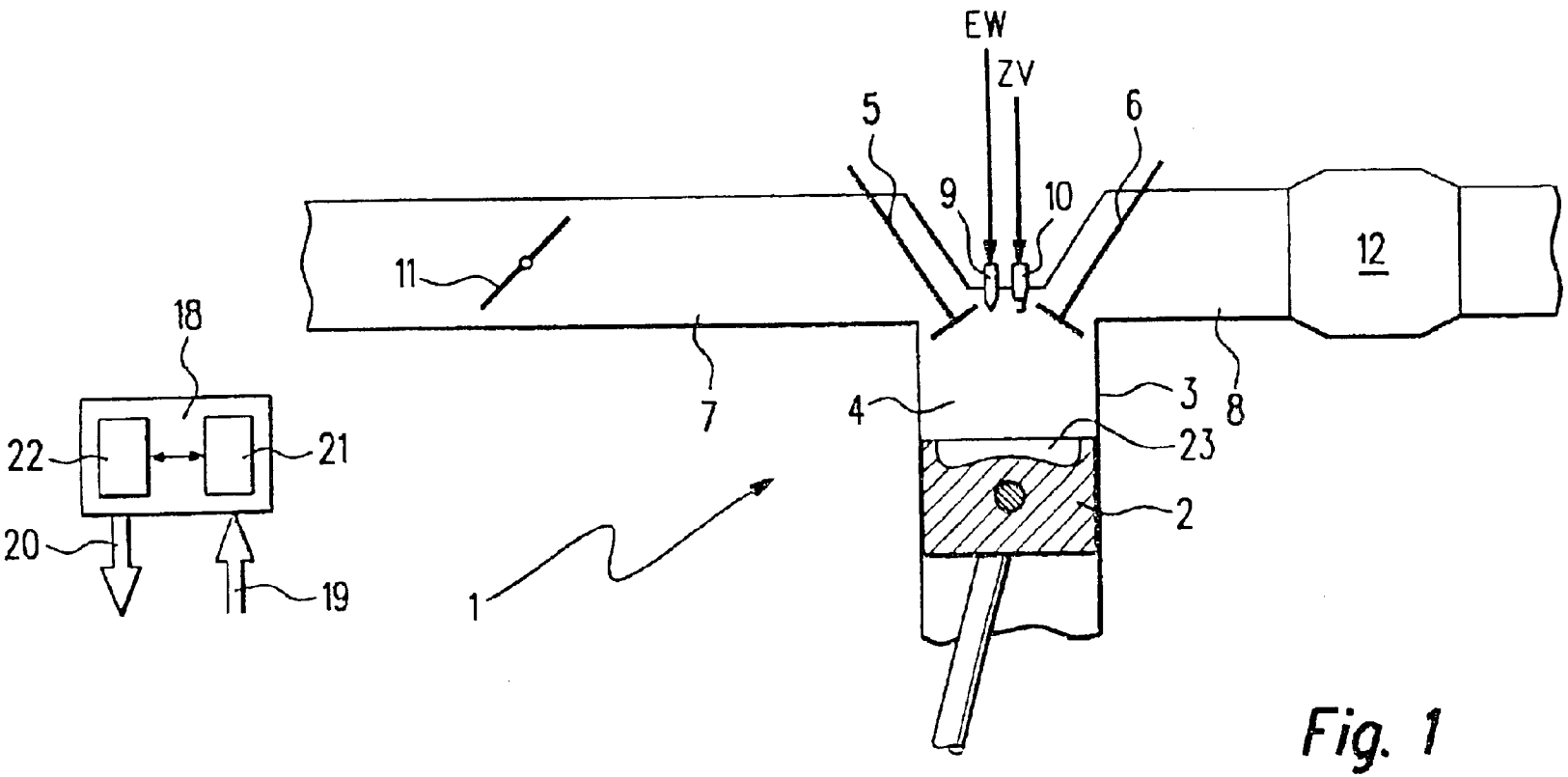
FIG. 1 shows a direct-injecting gasoline internal combustion engine of the invention in accordance with a preferred embodiment.

In FIG. 1, a direct-injecting gasoline internal combustion engine 1 of the invention of a motor vehicle is shown wherein a piston 2 is reciprocally movable in a cylinder 3. The cylinder 3 is provided with a combustion chamber 4 which is delimited, inter alia, by the piston 2, an inlet valve 5 and an outlet valve 6. An intake manifold 7 is coupled to the inlet valve 5 and an exhaust-gas pipe 8 is coupled to the outlet valve.

An injection valve 9 and a spark plug 10 project into the combustion chamber 4 in the region of the inlet valve 5 and the outlet valve 6. Gasoline is injected into the combustion chamber 4 via the injection valve 9. The air/gasoline mixture in the combustion chamber 4 can be ignited by the spark plug 10.

A rotatable throttle flap 11 is accommodated in the intake manifold 7 and air can be supplied to the intake manifold 7 via the throttle flap. The quantity of the supplied air is dependent upon the angular position of the throttle flap 11. A catalytic converter 12 is mounted in the exhaust-gas pipe 8 and functions to purify the exhaust gases which arise because of the combustion of the air/fuel mixture.

A reciprocal movement is imparted to the piston 2 by the combustion of the air/fuel mixture 4 and this movement is transmitted to a crankshaft (not shown) and applies a torque thereto.

A control apparatus 18 for controlling (open loop and/or closed loop) the direct-injecting internal combustion engine 1 is supplied with input signals 19 which define operating variables of the engine 1 measured by means of sensors. For example, the control apparatus 18 is connected to an air mass sensor, a lambda sensor, an rpm sensor and the like. Furthermore, the control apparatus 18 is connected to an accelerator pedal sensor which generates a signal indicating the position of the accelerator pedal, which is actuated by a driver, and therefore indicating the requested torque. The control apparatus 18 generates output signals 20 with which the performance of the engine 1 is influenced via actuators or positioning devices. For example, the control apparatus 18 is connected to the injection valve 9 (control signal EW), the spark plug 10 (control signal ZV), the throttle flap 11 and the like and generates the signals required for their control.

The control apparatus 18 is, inter alia, provided for the purpose of controlling (open loop and/or closed loop) the operating variables of the engine 1. For example, the fuel mass, which is injected by the injection valve 9 into the combustion chamber 4, is controlled (open loop and/or closed loop) by the control apparatus 18 especially in view of a low fuel consumption, a reduced toxic substance development and/or low noise generation. For this purpose, the control apparatus 18 is provided with a microprocessor 21 which has a computer program stored in a flash memory 22 which is suitable for carrying out the control (open loop and/or closed loop) and the method of the invention which is discussed in detail hereinafter.

The internal combustion engine 1 of FIG. 1 can be operated in a plurality of different operating modes. Thus, it is possible to operate the engine 1 in a homogeneous operation, a stratified operation, a homogeneous lean operation or the like. In the homogeneous operation, the fuel is injected during the induction phase directly into the combustion chamber 4 of the engine 1 by the injection valve 9. In this way, the fuel is still substantially swirled up to the ignition so that a substantially homogeneous air/fuel mixture arises in the combustion chamber 4. The torque, which is to be generated, is adjusted essentially by the control apparatus 18 via the position of the throttle flap 11. In the homogeneous operation, the operating variables of the engine 1 are controlled (open loop and/or closed loop) in such a manner that lambda=1. The homogeneous operation is used especially at full load.

The homogeneous lean operation corresponds substantially to the homogeneous operation. However, the lambda is adjusted to a value greater than 1.

In stratified operation, the fuel is injected during the compression phase directly into the combustion chamber 4 of the engine 1. In this way, no homogeneous mixture is present in the combustion chamber 4 at the ignition by the spark plug 10; instead, a fuel stratification is present. Apart from the requirements, for example, of an exhaust gas recirculation and/or a tank venting, the throttle flap 11 can be completely opened and the engine 1 can thereby be operated dethrottled. The torque, which is to be generated, is adjusted substantially via the fuel mass in stratified operation. With stratified operation, the engine 1 can be operated especially at idle and at part load.

There can be a switchover back and forth between the above-mentioned modes of operation of the engine. Switchovers of this kind are carried out by the control apparatus 18.

Figure 4:
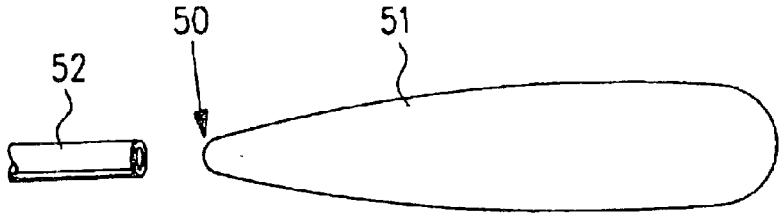

A combustion chamber cavity 23 is provided at the upper end of the piston 2. The injection valve 9 is mounted centrically to the combustion chamber cavity 23 and has a 6 to 8 hole nozzle. A jet-guided combustion process can be realized by the combustion chamber cavity 23 and the injection valve 9 which is especially configured. The engine 1 is operated in stratified operation. The air/gasoline mixture is ignited directly in advance of the discharge of the injection valve 9, that is, at the jet root. The spark plug 10 includes electrodes between which a spark path is formed after igniting the spark plug 10. The electrode gap is several millimeters and thereby lies significantly above the conventional electrode gap of approximately 1 mm. The relatively large electrode gap affords the advantage that many individual jets can be ignited in common with an injection valve 9 having a multi-hole nozzle or that the ignition can be transversely through the jet root of a gasoline injection jet 51 (see FIG. 4). In FIG. 4, an injection nozzle 52 of an injection valve 9 and the gasoline injection jet 51, which is injected into the combustion chamber 4, are shown with its geometric jet end 50. The spark path is arranged in the region of the jet root. The spark plug 10 is driven by the control apparatus 18 so that an ignition spark is ignited in advance of the gasoline injection and the spark path burns so long until the geometric jet end 50 (see FIG. 4) of the injection jet 51 has passed the spark path.

A conventional ignition voltage of approximately 25 to 30 kV is sufficient notwithstanding the relatively long electrode gap because ignition is early, that is, at low density. In accordance with the present invention, the ignition is achieved in that the spark, which is generated by the spark plug 10, burns over a relatively long time span in the combustion chamber 4. This time span starts in advance of the beginning of the injection and ends only after the end of the injection. Accordingly, a relatively long time span is available for the generation of the temperature necessary for the ignition of the air/gasoline mixture. The combustion is triggered by the injection of the gasoline into the combustion chamber 4.

Figure 2:
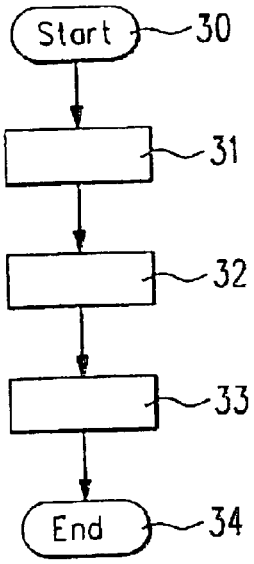
FIG. 2 shows a flowchart of the method of the invention in accordance with a preferred embodiment.
Figure 3:
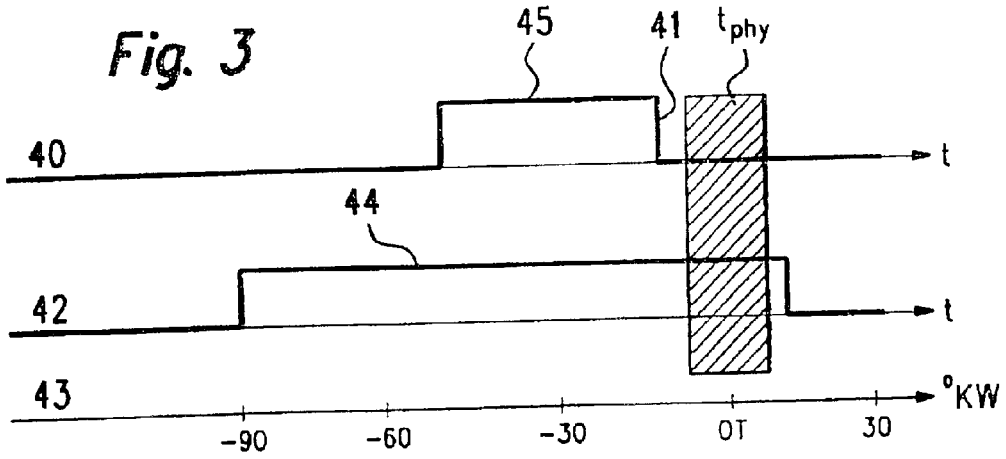
FIG. 3 shows a time-dependent course of the method of FIG. 2 in dependence upon the rotational angle position °KW of a crankshaft of the internal combustion engine; and, FIG. 4 shows a nozzle of an injection valve of the internal combustion engine of FIG. 1 and an injecting jet injected by the injection valve.

In FIG. 3, the time-dependent sequence of the method of FIG. 2 is shown. The injection course is identified by 40 and the ignition course is identified by 42 and a rotational-angle position °KW of the crankshaft of the engine 1 is identified by 43. The burn duration of the ignition spark is identified by 44 and the injection duration by 45. In a jet-guided combustion process in stratified operation, a so-called actual time region $t_{phy}$, which is coupled closely to the end 41 of the injection 45, is decisive for a successful ignition of the air/gasoline mixture. The air/gasoline mixture can only then successfully combust when the geometric jet end 50 (see FIG. 4) is ignited. This means that especially the actual time region $t_{phy}$ must be covered by the burn duration 44 of the spark path which is the case in the method of the invention. The beginning and the end of the burn duration 44 (that is, whether the ignition spark is ignited clearly earlier than the physical time region $t_{phy}$ or the spark path burns until significantly later) has a relatively slight influence on the combustion of the air/gasoline mixture. The relatively long burn duration 44, however, acts advantageously on the ignition voltage for the spark plug 10. In lieu of a relatively high ignition voltage of, for example, 50 kV or more, which is applied to the spark plug 10 only for a short time, a significantly lower voltage of, for example, 25 to 30 kV is sufficient in order to ignite the spark. The lower combustion voltage of typically <2 kV therefore lies, however, for a longer time span at the spark plug 10.

For the present invention, ignition systems are especially advantageous wherein the burn duration 44 of the ignition spark or of the spark path can be controlled. Such ignition systems are, for example: pulse-pull ignition systems, pulse-pull ignition systems having energy transfer in the charge phase, alternating current ignition systems or HF ignition systems.

In FIG. 2, a sequence diagram of a method of the invention is shown. The method starts in a function block 30. In a function block 31, an ignition spark is ignited by the spark plug 10 and is maintained burning. In a function block 32, gasoline is injected into the combustion chamber 4 of the engine 1. The function block 32 includes the entire gasoline injection from beginning to end. After the end of the injection 45, the burn duration 44 of the spark path is ended in a function block 33. Preferably, it is awaited until a geometric end 50 of the injection jet 51 (see FIG. 4) has passed the ignition location. In a function block 34, the method of the invention is then ended.

What is claimed is:

1. A method for operating a direct-injecting gasoline internal combustion engine, including a direct-injecting gasoline internal combustion engine of a motor vehicle, the method comprising the step of:

injecting gasoline directly into a combustion chamber of the engine; and, igniting an ignition spark in the combustion chamber in advance of the beginning of the injection and causing the spark duration to continue past the end of the injection.

2. The method of claim 1, wherein the internal combustion engine is operated in a stratified mode of operation.

3. The method of claim 1, wherein the internal combustion engine is jet-guidedly operated.

4. The method of claim 1, wherein the spark duration continues until the geometric end of the injection jet has passed the ignition location.

5. A storage element including a read-only-memory, random-access-memory or flash memory, the storage element being for a control apparatus of a direct-injecting gasoline internal combustion engine including a direct-injecting gasoline internal combustion engine of a motor vehicle, the storage element comprising a computer program stored thereon which is capable of being run on a computing apparatus including on a microprocessor and is suitable for carrying out a method including the steps of:

injecting gasoline directly into a combustion chamber of the engine; and, igniting an ignition spark in the combustion chamber in advance of the beginning of the injection and causing the spark duration to continue past the end of the injection.

6. A computer program comprising a method which is carried out when said computer program is run on a computer, the method being for operating a direct-injecting gasoline internal combustion engine including a direct-injecting gasoline internal combustion engine of a motor vehicle, the method including the steps of:

injecting gasoline directly into a combustion chamber of the engine; and, igniting an ignition spark in the combustion chamber in advance of the beginning of the injection and causing the spark duration to continue past the end of the injection.

7. The computer program of claim 5, wherein the computer program is stored on a storage element including on a flash memory.

8. A control apparatus for a direct-injecting gasoline internal combustion engine including a direct-injecting gasoline internal combustion engine of a motor vehicle, the control apparatus comprising:

means for controlling the injection of gasoline into a combustion chamber of the engine; and, means for igniting an ignition spark in the combustion chamber wherein an ignition of the ignition spark occurs in advance of the beginning of the injection and causes a spark duration to continue past the end of the injection.

9. A direct-injecting gasoline internal combustion engine including a direct-injecting gasoline internal combustion engine of a motor vehicle, the internal combustion engine comprising:

fuel injection system for directly injecting gasoline into a combustion chamber of the engine; and, an ignition system for igniting an ignition spark in the combustion chamber in advance of the beginning of the injection and supplying a spark duration past the end of the injection.

* * * * *